US005203920A

United States Patent [19]

Plomer

[11] Patent Number: 5,203,920

[45] Date of Patent: Apr. 20, 1993

[54] DEVICE FOR APPLYING A COATING COMPOSITION TO TRAVELING WEBS OF MATERIAL ON TWO WEB PATHS

[75] Inventor: Anton Plomer, Heidenheim, Fed. Rep. of Germany

[73] Assignee: J.M. Voith GmbH, Fed. Rep. of Germany

[21] Appl. No.: 694,133

[22] Filed: May 1, 1991

[30] Foreign Application Priority Data

May 8, 1990 [DE] Fed. Rep. of Germany ..... 4014647

[51] Int. Cl.[5] ..... B05C 1/12; B05C 3/132

[52] U.S. Cl. ..... 118/206; 118/217; 118/227; 118/228; 118/246; 118/249; 118/262; 118/405; 118/413

[58] Field of Search ..... 118/206, 216, 217, 223, 118/227, 304, 325, 228, 246, 248, 262, 405, 413

[56] References Cited

U.S. PATENT DOCUMENTS

| | | | |
|---|---|---|---|
| 1,695,319 | 12/1928 | Case | 118/206 |
| 1,809,146 | 6/1931 | Ross | 118/223 |
| 4,147,126 | 4/1979 | Riggs | 118/227 |
| 4,325,784 | 4/1982 | Dreher | 118/206 |
| 4,354,449 | 10/1982 | Zink | 118/206 |
| 4,413,586 | 11/1983 | Wöhrle | 118/206 |
| 4,529,921 | 4/1981 | Wallsten | 118/206 |
| 4,700,658 | 10/1989 | Beisswanger et al. | 118/67 |
| 4,848,268 | 7/1989 | Sollinger et al. | 118/227 |

FOREIGN PATENT DOCUMENTS 3836919 5/1990 Fed. Rep. of Germany .

*Primary Examiner*—W. Gary Jones
*Assistant Examiner*—Todd J. Burns
*Attorney, Agent, or Firm*—Ostrolenk, Faber, Gerb & Soffen

[57] ABSTRACT

A coating section for coating a traveling web of material, such as paper, wherein the web to be coated travels along a selected one of two different web paths. There is a lower counter roll and an upper press roll which define a nip between them and the distance apart of the two rolls is adjustable. A respective applicator for coating composition is on each of the first and second sides of the lower roll and on the third side of the upper roll, and the third side is the same side of the coating section as the first side of the lower roll. First web guide rollers guide the web from below, past the counter roll and the first applicator and not through the nip. Second guide rollers guide the web through the nip.

13 Claims, 2 Drawing Sheets

DEVICE FOR APPLYING A COATING COMPOSITION TO TRAVELING WEBS OF MATERIAL ON TWO WEB PATHS

BACKGROUND OF THE INVENTION

The present invention relates to a device for applying coating composition to two sides of a moving web of material.

Such a device is known from Federal Republic of Germany Published Application OS 34 17 487, which corresponds to U.S. Pat. No. 4,848,268. FIG. 1 thereof shows two press rolls which are horizontally opposite each other. Within the press nip formed between them, the rolls transfer the coating composition, which had been applied onto their outer surface(s), to a web of material. The coating applicator mechanism employed in each case is a device which carries an elastic doctor holder, including a revolving doctor having circumferential grooves that serve as the doctor element. This device enables application of very small amounts of coating with coating compositions having very low solids content. The amounts of coating composition applied can have a solids content of from 2 to 3 g/m$^2$ per side of the web of material. FIG. 3 of the patent shows a coating application arrangement using only one roll. A first coating applicator mechanism is associated at one side with the outer surface of the roll. On the other side, also in the region of the outer surface of the roll, there is a second coating applicator mechanism. It is provided with a nozzle chamber for applying coating composition directly onto the one side of the web of material. The other side of the web of material is coated from the outer surface of the roll. In FIG. 1 of that patent, the applicator mechanisms are each provided in the upper, outer quadrant (i.e., on the side of each roll facing away from in each case the other side) and are developed identically.

SUMMARY OF THE INVENTION

The object of the present invention is to provide a device which enables use of either of two possible methods of coating application, and at little expense. These include a doctor applicator mechanism with a sump, on the one hand, and an application mechanism with a nozzle chamber, on the other hand.

The invention concerns a coating section for coating a traveling web of material, such as paper, wherein the web to be coated travels along a selected one of two different paths. There is a lower counter roll and an upper press roll which define a nip between them. The distance apart of the two rolls is adjustable. A respective applicator for coating composition is disposed on the first and second sides of the lower counter roll and on the third side of the upper roll. The first and second sides are spaced around the peripheral surface of the counter roll at opposite (left and right) sides of the nip. The third side of the press roll is on the same side of the nip as the first side of the counter roll. First web guide rollers guide the web on a first web path from below, past the counter roll and the first applicator. Second guide rollers guide the web on a second web path from the first side of the counter roll through the nip.

Web guidance along the first web path is by means of guide rollers that may be arranged below the machine operator, and particularly in the cellar of the foundation for the coating section. This guides the web directly past the first coating applicator, which coats the outside of the web. The inside of the web also picks up coating material from the surface of the counter roll, which material has been applied to the roll by the second applicator. The web has on the outside a coating with a coating composition and on the other side the web has a coating of a slight sizing.

When the web is on the second web path through the nip between the rolls, the web can be coated on both sides with material that had been applied to the surfaces of the rolls.

At least the second and third applicators have resilient holders for their doctors which bear a revolving doctor with circumferential grooves and respective sumps of coating composition. See above noted U.S. Pat. No. 4,848,268. Those two applicators are located on different (the second and third) sides of the counter roll and the press roll, respectively. The first applicator is supported on means which enable it to be moved away from the roll as desired, e.g. when the web is travelling along the second path and it is not desired to contact the counter roll with the first applicator.

If deemed necessary, the two rolls can form a nip with each other. The rolls are arranged one above the other, rather than horizontally alongside of each other. This saves space which enables mounting of the required three applicator mechanisms in the vicinity of the two rolls in a way which permits access to each applicator mechanism for the operator in his customary working position.

The above described guidance of the web provides at most that only a small angle of wrap of a web around the rolls is required. A large angle of wrap might be of great disadvantage when absorptive paper is used. With the small amounts of solid substances to be applied, large angles of wrap could provide a danger that the web may travel in too dry a condition off one of the rolls. For this purpose, furthermore, a swingable support frame for a guide roller is arranged above the upper roll. Further guide rollers guide the web into the cellar below the operator floor of the lower roll in the event that the web is traveling on the first web path, on which it need not pass through the nip between the two rolls. This is useful for the coating variant in which the nozzle applicator mechanism of the lower roll is used. In this case, coating compositions are applied, in general with a dry contents coating weight of more than 7 g/m$^2$. There is a possibility of providing an additional drying device, for instance an infrared dryer, above the coating means for drying the side of the web of material which is coated with the coating composition.

Other features and advantages of the present invention will become apparent from the following description of the invention which refers to the accompanying drawing.

DESCRIPTION OF THE PREFERRED EMBODIMENT

Figure 1:
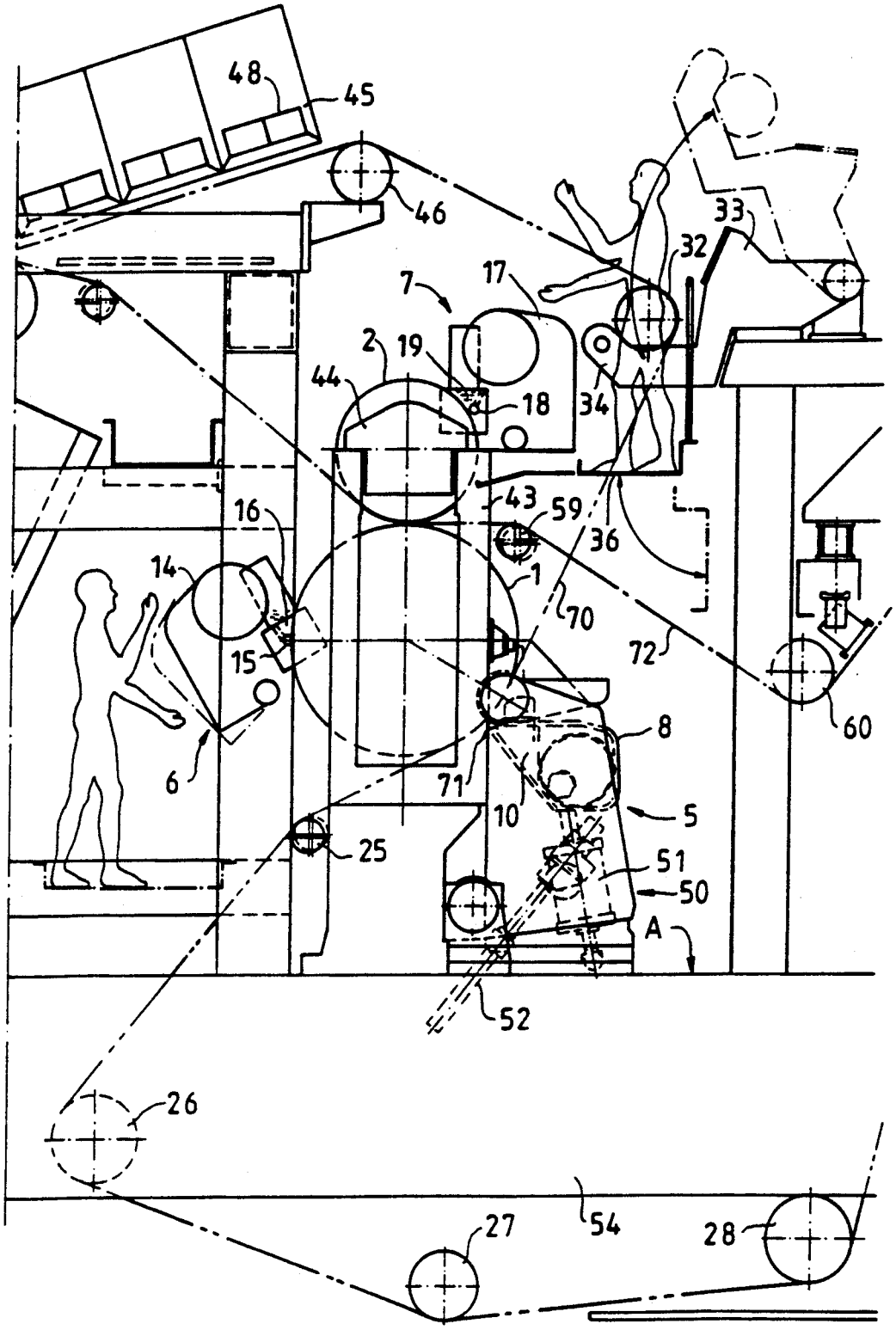
FIG. 1 shows an embodiment of the invention shown in principle, schematically and in cross section.

The drawing shows a coating section for coating a paper web. That section is located at the exit end of a paper making machine, e.g. after the drying section. A lower counter roll 1 is provided. A first web of material 70, which is shown in dash-dot line, passes along a first web path over the lower right, arcuate section of the circumference of the counter roll, but not through a nip defined between the roll 1 and a later described press roll 2 above the roll 1. Two applicator mechanisms 5 and 6 are associated with the counter roll 1 at opposite sides of the below described nip, around the peripheral surface of the counter roll. The applicator mechanism 5 has a so called nozzle chamber 10 which, in general, is developed to be combined with the doctor element 8 and which directly feeds the coating composition to the web of material, preferably under a pressure greater than atmospheric. The doctor element is generally a coating blade. An example of such an applicator mechanism 5 appears in above noted U.S. Pat. No. 4,848,268, incorporated herein by reference. Excess coating composition generally flows in a direction opposite the direction of travel of the web of material and into a receiving trough (not shown) via an overflow slot 71 formed in the nozzle chamber and at the counter roll 1. In this way, any desired amounts of coating composition can be applied, the composition having a solids content which is above 4 to 5 g/m$^2$ and up to about 15 g/m$^2$ per side of the web, which web is preferably of paper or cardboard. The applicator mechanism 5 is therefore located on the first side of the counter roll 1, which is along the lower right arcuate circumferential section over which the web of material is fed to the first applicator mechanism 5. The web is fed preferably from the paper making machine, which is off to the right of the coating mechanism and cannot be seen in the Figure. If this first applicator mechanism 5 is used, the web of material 70 is guided over guide rollers 25 to 28 along a path that is in part below the foundation 54 which forms the operator's plane A, and therefore is in the cellar, so that the web therefore travels to the nozzle applicator mechanism from the other (left) side of the roll 1.

On this other (left) side of the roll 1 is the applicator mechanism 6 having a revolving doctor bar 15 which is provided with circumferential grooves and is supported by a resilient holder. This may be the same type of applicator as mechanism 5, as described above, but preferably is of the type shown in U.S. Pat. No. 4,848,268, also incorporated herein by reference. The resilient holder with the revolving doctor rod 15, along with the supporting beam for these two elements form, on the outer surface of the counter roll 1, a sump of free flowing coating composition of a consistency of at most 8% of solids content, such as sizing. This coats the surface of the web in contact with the counter roll, that is the rear surface of the web, i.e. the web is impregnated to a greater or lesser extent, for instance for so called flat lying correction when the coating composition is applied by nozzle applicator 5 on the other or front side of the web of material.

Above the counter roll 1, there is a press roll 2. An applicator mechanism 7, which is similar to the second applicator mechanism 6 of the lower counter roll 1, is associated with the press roll 2. In this case also, there is a revolving doctor 18 with a resilient holder 20, which are supported by a doctor beam 17 and together form a sump 19 of coating composition on the outer surface of the press roll 2 and away from the web.

Figure 2:
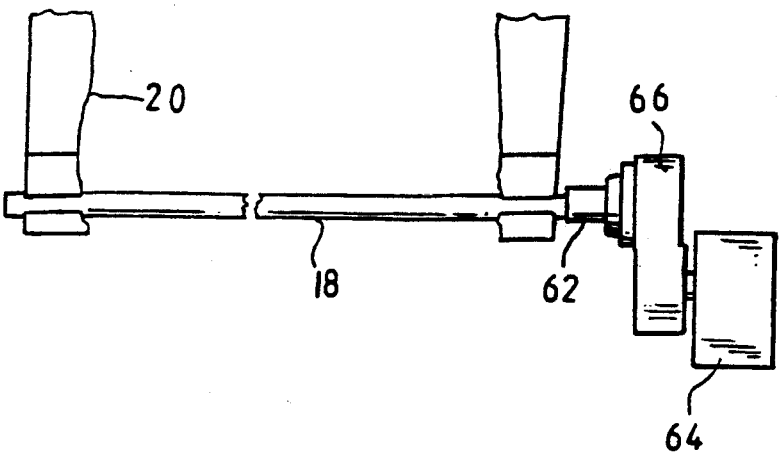
FIG. 2 is a plain view of the rotatably driven doctor roll.

FIG. 2 shows a drive for the doctor roll 18 wherein that roll is coupled via a flexible shaft 62 to a gear 66 and a motor 64, which is preferably electric.

A roller frame mounting 43 for both rolls 1 and 2 permits displacement either of the support and bearing 44 of the press roll 2 or displacement of the counter roll 1 in a vertical direction by about 1 to 2 cm.

Upon placing the nozzle applicator mechanism 5 out of operation and pivoting it outward away from the counter roll 1, it is possible to bring the two rolls 1 and 2 toward each other to form a nip between them. The coating material is then transferred from the sump 16 and/or 19 of either or both of the two applicator mechanisms 6 or 7, which are respectively provided on the outer surfaces of the two rolls 1 or 2 and onto the second web of material 72. The revolving doctors 15 and 18 have fine circumferential grooves for the purpose of accurate and uniform dosaging of coating composition. In this case, the web of material 72 passes along a second web path shown by the dot-dash line. The web does not pass through the cellar. Instead the web is guided by further guide rollers 59 and 60 to enter directly into the nip formed between the two rolls 1 and 2 from the first side of the lower counter roll 1.

The solids content of the coating composition applied amounts up to about 16% in the case of sizing and up to 35% or possibly up to 50% in the case of pigmenting. The corresponding application weights per unit of area then amount to 2 to 4 g/m$^2$ and 4 to 7 g/m$^2$ of solids content, respectively.

Since in the case of the second web path the upper applicator mechanism 7 associated with the press roll 2 is in operation, an operator's upper platform is also provided. This comprises at least one operator's floor 36, which is swung into the operational position shown in solid line so that the operator can carry out his work there. In this case, a guide roller 32, which is provided for the other coating operation on web 70, is swung out of the region of the operating platform 36. For this purpose, the roller 32 is mounted on a swing device 33 which supports the guide roller 32 on an arm 34.

The swing device 33 is operated by a one directional (lifting only) hydraulic piston-cylinder unit 66 that is at one end pivotally connected to the swing device 33 and at the other end to the stationary mounting frame part 69. Operation of the unit 66 swings the device 33.

There is a similar but two directional hydraulic piston-cylinder unit 68 for the swingable platform 36, which platform may be swung around the hinge 67. The bracket 63 is attached to the platform 36. The unit 68 is pivotally attached to the bracket at a location spaced away from the hinge pivot 67. The other end of the unit 68 is pivotally attached to the frame part 69.

The guidance of the web 72 on the second path corresponding to the double-dot dash line is past an additional drying device 45, which may be provided above the coating section for drying the side of the web material which has a considerably thicker application of the coating composition supplied to it from the nozzle applicator mechanism 5. The drying device 45 can, for instance, have infrared drying elements 48. A further guide roller 46 conducts the web past the additional drying device.

As can be noted from the Figure, the point of attack of the revolving doctor 15 of the applicator mechanism 6 for the counter roll 1 is, as seen in a horizontal direction, approximately across the horizontal diameter through the center of the roll 1. As a result, upon displacement of the roll in either vertical direction by 1 or 2 cm, the position of the resilient holder of the revolving doctor 15, in the condition when it is pressed against the outside of the roller, changes only slightly. By a slight swinging of the holding device of the resilient holder, the change in distance from the revolving doctor to the outer surface of the counter roll 1 which then occurs can readily be compensated for. The applicator mechanism 6 therefore need not be displaceable in the vertical direction. This, of course, still further simplifies the entire arrangement.

For the coating device, there is a frame 50 on the foundation 54 to hold the nozzle chamber applicator mechanism 5 in order to permit displacement of its angular position with respect to the counter roll 1 and to permit its swinging away from the roll 1. Displacement devices 51 and 52 are provided for enabling the angular swinging.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A device for applying coating composition to a web which passes through the device on a selected one of two different web paths, the device comprising:

a lower rotatable counter roll having a first periphery for support of a web thereon and being rotatable between spaced apart first and second sides;

a first applicator at the first side of the counter roll, the first applicator including first means for applying a first coating composition directly onto a first web;

first web guide means for guiding the first web along the first one of the web paths around the counter roll past the first applicator;

a second applicator at the second side of the counter roll, the second applicator including second means for applying a second coating composition to the counter roll at the second side;

a rotatable upper press roll located above the counter roll at a distance therefrom as to form a nip with the counter roll at the top of the counter roll; the press roll having a respective second periphery and being rotatable between respective spaced apart third and fourth sides, the nip being formed between the first and second sides of the counter roll and the third and fourth sides of the press roll;

a third applicator at the third side of the press roll, the third applicator including third means for applying a third coating composition to the press roll at the third side;

second web guide means for guiding a second web along the second web path through the nip between the counter roll and the press roll and not past the first applicator;

the second web guide means being so positioned and the counter roll and the press roll being so rotatable that the second path of the second web is through the nip from the first to the second sides of the counter roll;

first web guide means including first guide rollers being positioned for directing the first web up to the counter roll from below such that the first web approaches the counter roll from below and from the second side of the counter roll; and respective first and second means for mounting the counter roll and the press roll for rotation, and at least one of the mounting means being movable for adjusting the width of the nip between the rolls.

2. The device of claim 1, wherein:

the second applicator comprises a first sump for the second coating composition, a first doctor element for doctoring a layer of the second coating composition from the first sump to the periphery of the counter roll at the second side thereof, and a first flexible doctor holder for the first doctor element for flexibly applying the first doctor element to the periphery of the counter roll at the second side thereof; and the third applicator comprises a second sump for the third coating composition, a second doctor element for doctoring a layer of the third coating composition from the second; sump to the periphery of the press roll at the third side thereof, and a second flexible doctor holder for the second doctor element for flexibly applying the second doctor element to the periphery of the press at the third side thereof.

3. The device of claim 1, further comprising a frame for supporting the counter roll and the press roll, the bearing means for movably supporting the press roll with respect to the frame for adjusting the nip.

4. The device of claim 1, wherein generally at the third side of the press roll, a second guide roller of the first guide means is disposed spaced away from the press roll, and the second guide roller has a position generally in the vicinity of the press roll.

5. The device of claim 4, further comprising a swing device for supporting the second guide roller thereon and for swinging the second guide roller between a position lying closer to the third side of the press roll and a position swung away from the press roll.

6. The device of claim 5, further comprising an operator's platform which extends toward the press roll and means supporting the operator's platform for being movable away from the press roll.

7. The device of claim 1, further comprising an operator's platform which extends toward the press roll and means supporting the operator's platform for being movable away from the press roll.

8. The device of claim 1, wherein the first guide rollers are arrayed below the counter roll, and the counter roll and the first guide rollers being positioned for guiding the first web along the first web path to the counter roll upstream on the first periphery of the counter roll from the first applicator and for guiding the first web on the counter roll past the first applicator.

9. The device of claim 1, wherein the first applicator includes a doctor element and the respective doctor elements of the second and third applicators comprise a respective revolving doctor with circumferential grooves for coating selected weights of coating material per unit area.

10. The device of claim 9, wherein the revolving doctors are adapted for applying low weights of application of coating material per unit of area with consistencies of the coating composition of at most 50% of solids materials.

11. The device of claim 1, wherein the first side of the counter roll is the side toward which the second web is guided along the second web path and is also the side past which the second web passes along the first web path.

12. The device of claim 1, further comprising means supporting the first applicator selectively for movement away from the counter roll when the second web is travelling on the second web path and movable to bring the applicator to the counter roll when the first web is being guided along the first web path.

13. The device of claim 1, wherein the first applicator is movable between a position adjacent the counter roll when the first web is following the first path and movable to a second position spaced at the counter roll when the second web is following the second path.

* * * * *